US007120257B2

(12) United States Patent
Mahoney

(10) Patent No.: US 7,120,257 B2
(45) Date of Patent: Oct. 10, 2006

(54) AUDIBLE SOUND DETECTION CONTROL CIRCUITS FOR TOYS AND OTHER AMUSEMENT DEVICES

(75) Inventor: Charles R. Mahoney, South Orange, NJ (US)

(73) Assignee: Mattel, Inc., El Segundo, CA (US)

( * ) Notice: Subject to any disclaimer, the term of this patent is extended or adjusted under 35 U.S.C. 154(b) by 66 days.

(21) Appl. No.: 10/666,369

(22) Filed: Sep. 18, 2003

(65) Prior Publication Data

US 2004/0141620 A1 Jul. 22, 2004

Related U.S. Application Data

(60) Provisional application No. 60/440,814, filed on Jan. 17, 2003.

(51) Int. Cl.
*H04R 29/00* (2006.01)

(52) U.S. Cl. ..... 381/56; 446/175; 367/198

(58) Field of Classification Search ..... 381/56, 381/110; 446/175; 84/464 R, 464 A; 367/198
See application file for complete search history.

(56) References Cited

U.S. PATENT DOCUMENTS 4,085,542 A 4/1978 Mitamura
4,139,968 A 2/1979 Milner
4,165,581 A 8/1979 Wolf
4,221,927 A 9/1980 Donkman et al.
4,231,184 A * 11/1980 Corris et al. ..... 446/175
4,245,430 A 1/1981 Hoyt
4,258,291 A * 3/1981 Scott et al. ..... 367/197
4,357,488 A 11/1982 Knighton et al.
4,394,656 A * 7/1983 Goettsche ..... 84/464 R
4,670,864 A * 6/1987 Hoffmann ..... 367/198
4,696,653 A 9/1987 McKeefery
4,717,364 A 1/1988 Furukawa
4,740,186 A 4/1988 Sirota
4,889,027 A 12/1989 Yokoi
4,923,428 A 5/1990 Curran
4,973,286 A * 11/1990 Davison ..... 446/175
5,040,319 A 8/1991 Wang et al.
5,158,212 A * 10/1992 Sirhan ..... 446/175
5,176,560 A 1/1993 Wetherell et al.
5,209,695 A 5/1993 Rothschile
5,281,143 A 1/1994 Arad et al.
5,324,225 A 6/1994 Satoh et al.
5,402,702 A 4/1995 Hata
5,407,376 A 4/1995 Avital et al.
5,452,274 A 9/1995 Thompson
5,493,618 A 2/1996 Stevens et al.
5,501,131 A * 3/1996 Hata ..... 84/464 R (Continued)

*Primary Examiner*—Brian T. Pendleton
(74) *Attorney, Agent, or Firm*—Akin Gump Strauss Hauer & Feld, LLP

(57) ABSTRACT

A control circuit for an amusement device includes a sound detector, a band-pass filter, a peak integrator and a controller. The sound detector is configured to detect audible sound signals. The band-pass filter is electrically coupled to the sound detector. The band-pass filter is configured to extract sound signals in a predetermined audible frequency range and to output a corresponding filtered signal. The peak integrator is electrically coupled to the band-pass filter. The peak integrator is configured to receive the filtered signal, to average peaks of the filtered signal and to output a trigger signal based on a predetermined range of the averaged filter signal. The controller is electrically coupled to the peak integrator. The controller is configured to receive the trigger signal and to provide a control output in response to the trigger signal.

19 Claims, 5 Drawing Sheets

U.S. PATENT DOCUMENTS 5,615,271 A 3/1997 Stevens et al.
5,647,787 A * 7/1997 Raviv et al. ..... 446/175
5,886,631 A 3/1999 Ralph
5,989,092 A 11/1999 McGowan et al.
6,039,626 A 3/2000 Gerold et al.
6,149,491 A 11/2000 Arad et al.
6,253,058 B1 6/2001 Murasaki et al.
6,394,872 B1 5/2002 Watanabe et al.
6,491,516 B1 12/2002 Tal et al.
6,514,117 B1 2/2003 Hampton et al.
6,555,979 B1 4/2003 Arnold et al.
2001/0031602 A1 10/2001 Sagi-Dolev
2002/0081937 A1 6/2002 Yamamada et al.
2002/0086607 A1 7/2002 Chan
2002/0098879 A1 7/2002 Reheay
2002/0127945 A1 9/2002 Cheng

* cited by examiner

AUDIBLE SOUND DETECTION CONTROL CIRCUITS FOR TOYS AND OTHER AMUSEMENT DEVICES

CROSS-REFERENCE TO RELATED APPLICATIONS

This application claims the benefit of U.S. Provisional Patent Application No. 60/440,814, filed Jan. 17, 2003, entitled "Audible Sound Detection Control Circuit for Toys and Other Amusement Devices."

BACKGROUND OF THE INVENTION

The present invention relates generally to control circuits, and more particularly, to sound detection control circuits for toys and other amusement devices.

Audible sound detection circuits are generally known in the art. One such audible sound detection circuit is disclosed in U.S. Pat. Nos. 5,493,618 and 5,615,271, both of Stevens et al. (hereinafter, "Stevens"). Stevens discloses a control circuit having a sound detector which is applied through a filter and a peak detector to a microcontroller and which is separately applied through an amplifier and a peak detector to the microcontroller. The microcontroller monitors both the filtered and the unfiltered inputs from the sound detector and counts the number of sounds (claps) detected within a window of time. The microcontroller must detect at least two sounds (claps) within a certain window or period of time, for example within 1.5 seconds. Alternate embodiments allow the microcontroller to take other actions when three sounds (claps) or four sounds (claps) are detected within the window of time. The Stevens circuit requires not only that the sounds be above a predetermined level, but also that two or more sounds above that level occur in sequence within the window of time.

Other, more complex prior art control circuits, such as those disclosed in U.S. Pat. Nos. 4,513,189, 4,641,292, 4,856,072 and 5,199,080, are responsive to voice activation. Generally, voice activated circuits require a complex voice recognition portion of the circuit including pattern analyzers, multiplexers, and memory for retaining a database of "learned" words. Most of the voice recognition circuits require the user to "train" the voice activated circuit to teach the circuit (database) words spoken by the user. Due to the complexity of the circuits, they tend to be expensive and not applicable to toys and games and the like. Furthermore, due to the complexity of training the circuits, they are not well suited to young children and/or children who cannot speak or cannot follow the instructions needed to "teach" the circuit(s).

There are many prior art toys that are responsive to remote controls that emit radio frequencies (RF) or infrared (IR) signals. The remote control responsive circuits require complex receiver circuitry and an antenna or photocell in addition to the control circuit. Furthermore, such circuits normally require a particular and separate remote control unit having a powered transmitter, antenna or infrared light emitting diode capable of emitting a complex communication signal outside of the audible frequency range. Normally such remote controls are complex in nature having buttons, knobs, dials, joysticks and the like, and require a certain degree of dexterity by the user. Furthermore, the additional remote control circuit adds unnecessary expense to a toy or an amusement device which only needs an initiation or trigger signal.

What is needed but not provided by the prior art is an inexpensive and easy to use remote control system, especially one simple enough for literally an infant to use.

BRIEF SUMMARY OF THE INVENTION

Briefly stated, the present invention is a control circuit for an amusement device. The control circuit comprises a sound detector, a band-pass filter, a peak integrator and a controller. The sound detector is configured to detect audible sound signals. The band-pass filter is electrically coupled to the sound detector. The band-pass filter is configured to extract sound signals in a predetermined audible frequency range and to output a corresponding filtered signal. The peak integrator is electrically coupled to the band-pass filter. The peak integrator is configured to receive the filtered signal, to average peaks of the filtered signal and to output a trigger signal based on a predetermined range of the averaged filter signal. The controller is electrically coupled to the peak integrator. The controller is configured to receive the trigger signal and to provide a control output in response to the trigger signal.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown.

In the drawings.

DETAILED DESCRIPTION OF THE INVENTION

Figure 1:
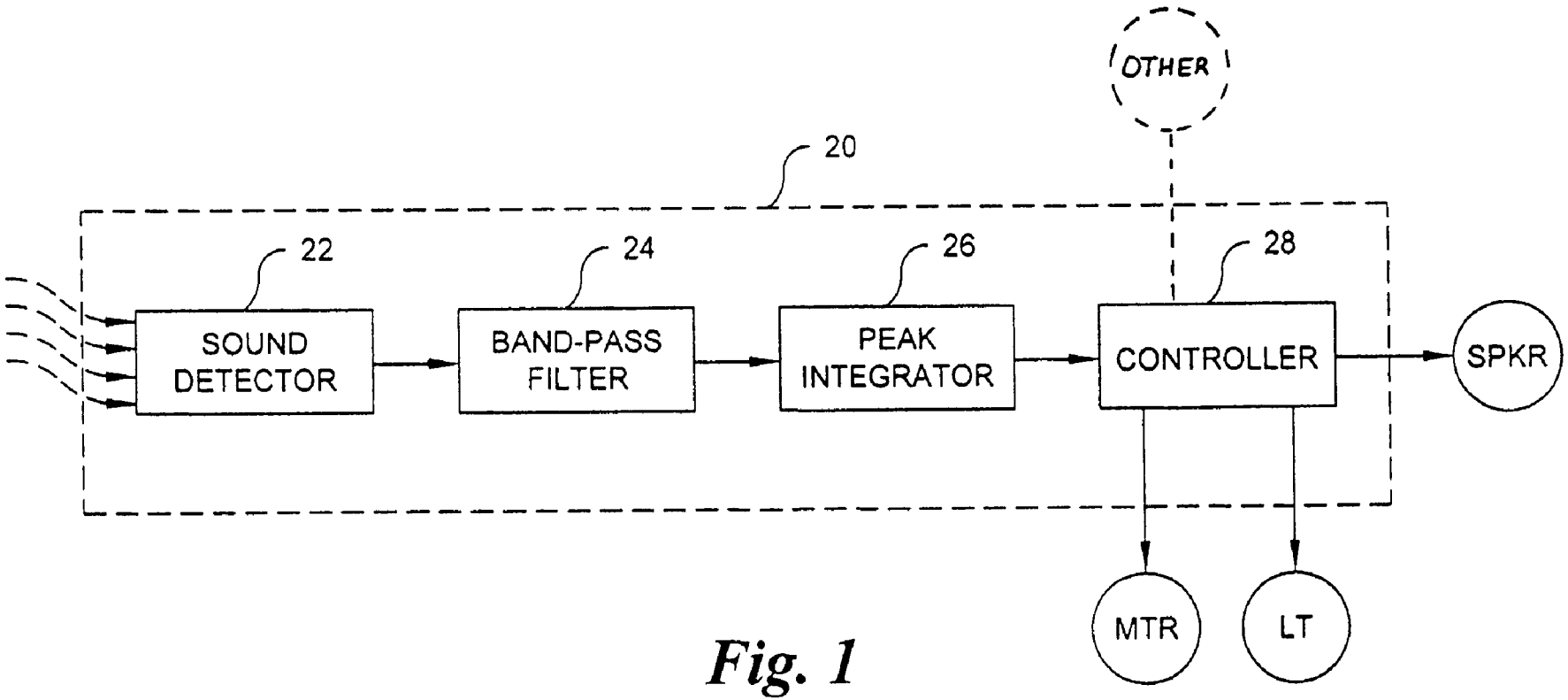
FIG. 1 is a general schematic block diagram of a control circuit in accordance with the present invention.

Certain terminology is used in the following description for convenience only and is not limiting. The words "right", "left", "lower", and "upper" designate directions in the drawing to which reference is made. The words "inwardly" and "outwardly" refer direction toward and away from, respectively, the geometric center of the disk prosthesis and designated parts thereof. The terminology includes the words above specifically mentioned, derivatives thereof and words of similar import. Additionally, the word "a", as used in the claims and in the corresponding portions of the specification, means "at least one."

Figure 2:
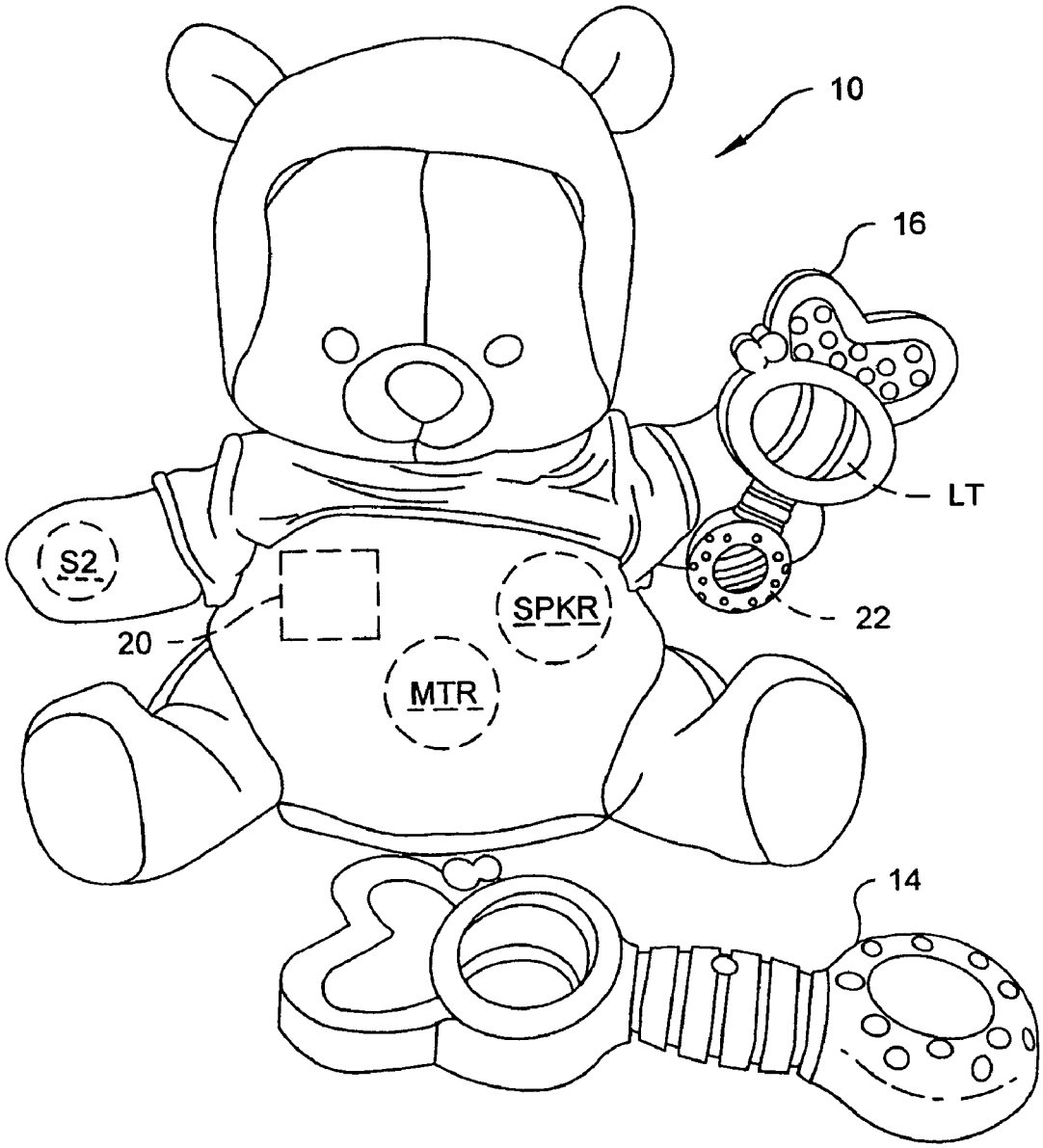
FIG. 2 is a perspective view of a toy utilizing the control circuit of FIG. 1.
Figure 3A:
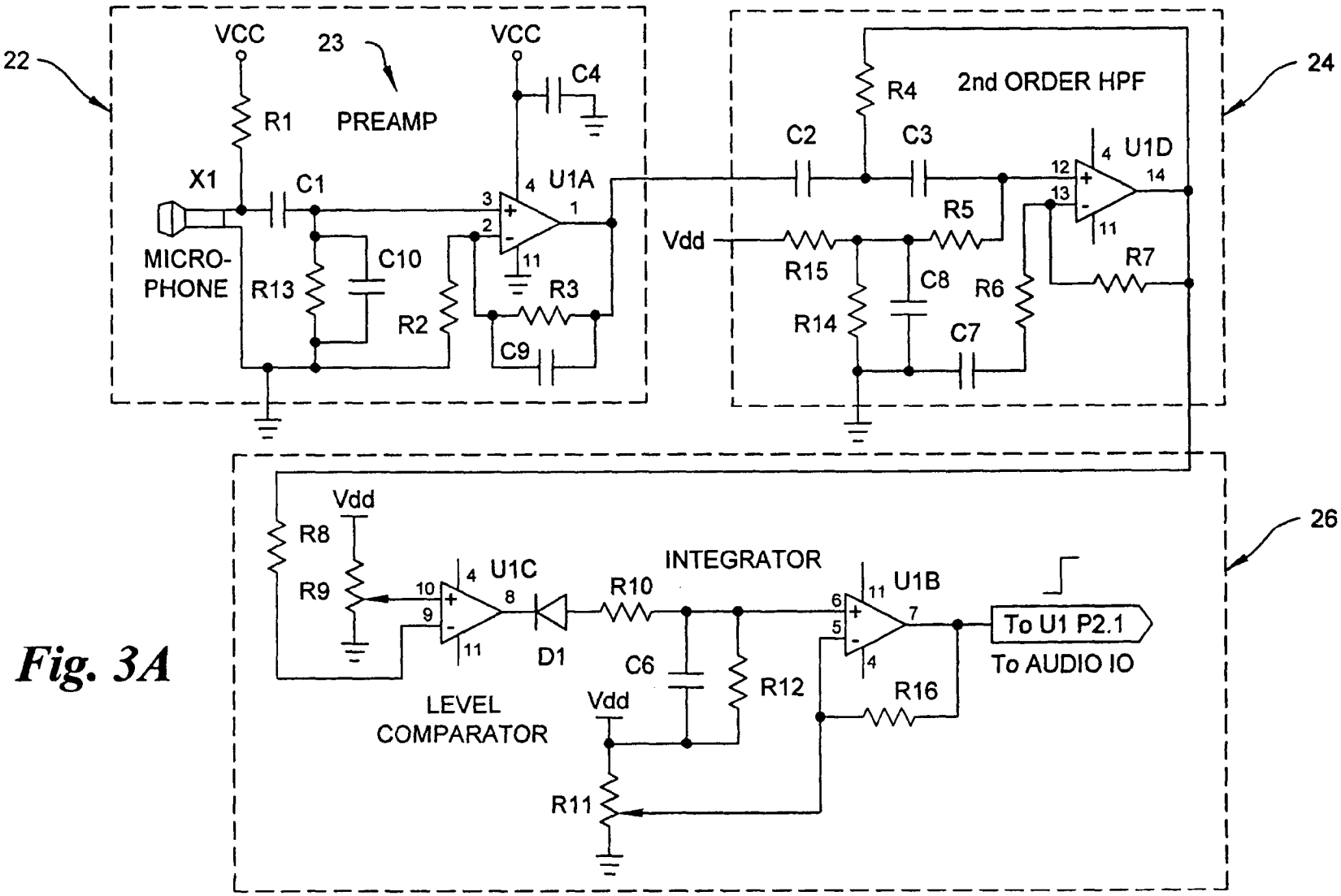
FIGS. 3A–3E are detailed circuit schematics of the control circuit of FIG. 1.

Referring to the drawings in detail, wherein like reference numerals indicate like elements throughout, there is shown in FIGS. 1–2 a control circuit 20 for a toy or other amusement device 10 that includes a sound detector 22, a band-pass filter 24, a peak integrator 26 and a controller 28. The sound detector 22 is configured to detect audible sound signals. Preferably, the sound detector 22 includes a microphone X1 (FIG. 3A). The band-pass filter 24 is electrically coupled to the sound detector 22. The band-pass filter 24 is configured to extract sound signals in a predetermined audible frequency range and to output a corresponding filtered signal. Preferably, the predetermined frequency range is between about 6.8 KHz and 8.2 KHz, but may be other audible frequency ranges without departing from the present invention.

The peak integrator 26 is electrically coupled to the band-pass filter. The peak integrator 26 is configured to receive the filtered signal, to average peaks of the filtered signal and to output a trigger signal based on a predetermined range of the averaged filter signal. The controller 28 is electrically coupled to the peak integrator 26. The controller 28 is configured to receive the trigger signal and to provide a control output in response to the trigger signal. The controller 28 may include a sound synthesizer, a microcontroller, a microprocessor, an application specific integrated circuit (ASIC) and the like, as will be described in greater detail below. Preferably, the controller 28 includes a sound synthesizer integrated circuit (IC)-type controller that combines sound generation and general control functions. Of course, sound generation and general control functions could be provided in a combination of hardwired or integrated circuits without departing from the present invention.

In the depicted exemplary embodiment, the control output from controller 28 controls at least one of a light LT, a motor MTR and a sound output device SPKR. Of course, other elements and types of elements (OTHER in phantom) can be controlled. Preferably, there are a plurality of control outputs which separately and/or simultaneously control the light LT, the motor MTR and the sound output device SPKR.

Preferably, the predetermined range of the averaged filter signal is selected based upon the sound characteristics of another particular object or device, for example, a toy noise maker for infants. For infants, the toy noise maker may be a particular rattle 14 (FIG. 2), and the control circuit 20 is pre-tuned to the predetermined frequency range and the predetermined range of the averaged filter signal and by other minor settings to be responsive to the rattle 14.

FIGS. 3A–3E show one possible implementation of the control circuit 20 in detail. The sound detector 22 includes the microphone X1 and a preamplifier 23 along with suitable biasing components including resistors R1–R3 and R13 and capacitors C1, C4 and C9–C10. The preamplifier 23 includes an operational amplifier (op-amp) U1A. The microphone X1 is capable of detecting audible sound over a broad range of frequencies. The preamplifier 23 functions to amplify the signal level as well as pre-filter or condition the signal to reduce noise. The preamplifier 23 also provides suitable input and output impedances to match the microphone X1 to the band-pass filter 24.

The output of the op-amp U1A is coupled through capacitor C2 to the band-pass filter 24. The band-pass filter 24 includes op-amp U1D along with suitable biasing components including resistors R4–R7 and R14–R15 and capacitors C2–C3 and C7–C8. This particular band-pass filter 24 is arranged as a second order high pass filter configured to extract or filter signals in a predetermined frequency range. The band-pass filter 24 generally allows passage of a single transmission band and neither of the cutoff frequencies (lower and upper) are zero or infinite, as is known in the art. Of course, additional op-amps U1D may be used to create higher order filters without departing from the present invention.

The output of op-amp U1D, which forms the output of the band-pass filter 24, is applied through limiting resistor R8 to the peak integrator 26. Particularly, the output of op-amp U1D is applied through the limiting resistor R8 to the inverting input of comparator U1C. The other input of the comparator U1C receives an adjustable voltage set by potentiometer R9 in order to adjust the minimum passable peak detected by the comparator U1C. The peak integrator 26 further includes an op-amp U1B along with suitable biasing components including resistors R10, R12 and R16, potentiometer R11, diode D1 and capacitor C6. The output of the comparator U1C is applied through diode D1 and limiting resistor R10 to the op-amp U1B. Potentiometer R11 allows adjustability of the time base for the peak integrator 26.

Figure 3B:
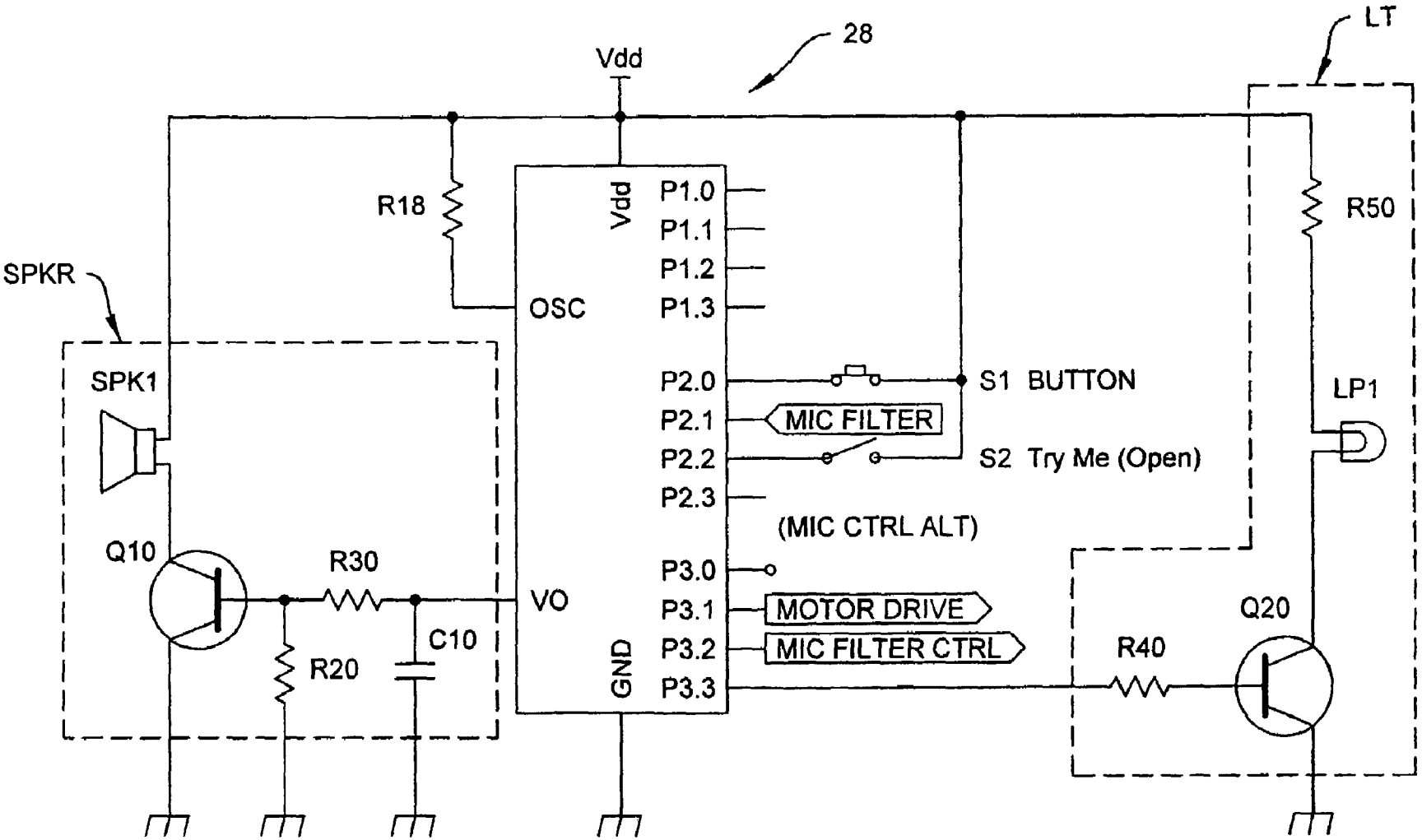

The output of the op-amp U1B forms the output of the peak integrator 26 and is applied to the controller 28. The output of the peak integrator 26 is generally a step function (i.e., on or off). One preferred form of the controller 28 is depicted in FIG. 3B and includes a microcontroller IC U1, in this case with an audio synthesizer capability. The step function output of the op-amp U1B is applied to an input 2.1 of the microcontroller IC U1. The microcontroller IC U1 has an oscillator input OSC adjusted by a voltage dropped over resistor R18 and a voltage supply input Vdd. The microcontroller IC U1 also includes an input P2.0 for detecting the status of an on/off button S1 and an input P2.2 for detecting the status of a "try-me" button S2. The microcontroller IC U1 also includes a digital output P3.1 for driving the motor MTR and a digital output P3.2 for disabling the sound detector 22 by gating a pull-down transistor Q1 (FIG. 3E). The microcontroller IC U1 also includes a digital output P3.3 for energizing the light LT. The microcontroller IC U1 also includes an analog output VO for driving the sound output device SPKR. It will be appreciated that either digital or analog outputs could be used in each instance.

Figure 3D:
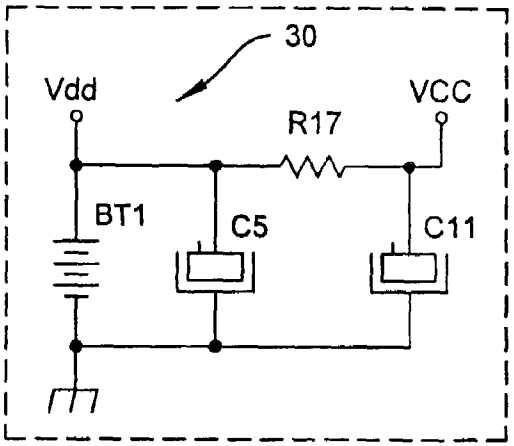
Figure 3E:
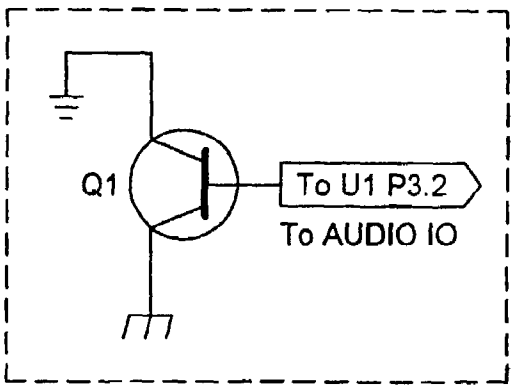
Figure 3C:
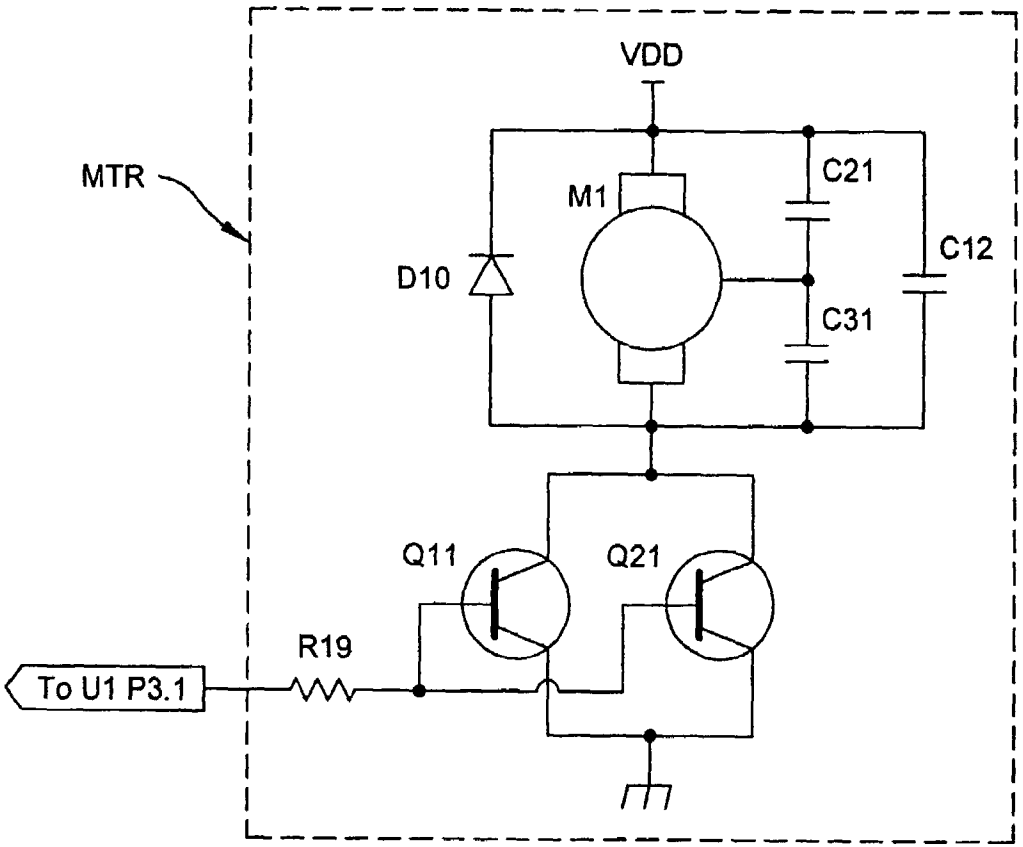

The motor MTR shown in FIG. 3C includes a direct current (DC) motor M1, drive transistors Q11 and Q21, a diode D10 along with suitable biasing components including resistor R19 and capacitors C12, C21 and C31. The drive transistors Q11, Q21 function as current amplifiers for the motor output signal. The light LT in FIG. 3B includes transistor Q20, light emitting diode (LED) LP1 and resistors R40 and R50. Transistor Q20 functions as a current amplifier for the light output signal. The sound output device SPKR includes speaker SPK1 and transistor Q10 along with suitable biasing components including resistors R20 and R30 and capacitor C10. Transistor Q10 functions as a current amplifier for the variable analog sound output signal.

The control circuit 20 further includes a power supply 30 shown in FIG. 3D. The power supply 30 includes batteries BT1–BT2, tank capacitors C5 and C11 and resistor R17. The batteries BT1–BT2 may be any conventional battery type, but preferably, the batteries BT1–BT2 are AA-type batteries.

While FIGS. 3A–3E depict one possible detailed circuit implementation, it should be obvious to one skilled in that art that other circuit implementations utilizing other components or combinations of components may be implemented without departing from the broad inventive scope of the present invention.

In use, the on/off switch S1 disposed on the device 10, in this case a toy bear, is closed or actuated by a user. The user then shakes the rattle 14 for a predetermined duration of time, for example 2–3 seconds or more. The sound detector circuit 22 picks up the audible sound emitted by the shaking rattle 14. The shaking rattle 14 is of a particular size, shape and material of construction such that the emitted audible sound for rattles 14 of similar construction possess the same emitted sound frequency characteristics. The band-pass filter 24 and the peak integrator 26 are adjusted at the factory to detect a characteristic frequency range of the particular rattle 14 while filtering out extraneous noise such as laughter, clapping, talking and the like. The peak integrator 26 detects the desired frequency for the predetermined period of time by rejecting signals below the minimum peak through the comparator U1C and averaging the peak signals through the op-amp U1B and its associated adjustable time base. If the rattle sound is detected from the filtered output for a sufficiently long period of time (e.g., 1–100 ms) in order to exclude transient sounds in the frequency range, the peak integrator 26 then outputs the trigger signal to the controller 28. The microcontroller IC U1 of the controller 28 then begins a preconfigured or preprogrammed control sequence.

For example, in one preferred control sequence, the microcontroller IC U1 disables the sound detector 22 by energizing the pull-down transistor Q1 during the control sequence so that any sound generated by the control sequence itself will not retrigger the control circuit 20. Then, the microcontroller IC U1 generates a sound output signal to the sound output device SPKR such as a giggle, laugh or sound bite. Next, the microcontroller IC U1 generates music via the sound output device SPKR while simultaneously flashing the light LT and energizing the motor MTR. In this example, the light LT is disposed in a mini-rattle 16 held in the paw of the toy bear 10, and the motor MTR is disposed within the toy bear 10. The motor MTR is coupled to a rocker or rocking mechanism (not shown) which bends the toy bear 10 back and forth giving the appearance of rocking to the beat of the music. After a predetermined period of time, the microcontroller IC U1 de-energizes the motor MTR, the light LT and the pull down transistor Q1, thereby permitting detection of sound once again upon completion of a control sequence. If the user had continued to shake the rattle 14 during and after the control sequence, another control sequence would begin again. Of course other control sequences could be implemented without departing from the present invention.

While the control circuit 20 as described herein is applied to a toy bear 10 and a rattle 14, it would be obvious to one skilled in the art that such a control circuit 20 could be used in any number of toys. For example, the control circuit 20 could be installed in other stuffed animals, toy figures, toy vehicles, games, talking or musical books and the like.

From the foregoing, it can be seen that the present invention comprises an audible sound detection control circuit for an amusement device capable of causing a control action in the device. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims. Application No. 60/440,814 is incorporated by reference herein in its entirety.

I claim:

1. An amusement device having a control circuit, the control circuit including a sound detector configured to detect audible sound signals and a band-pass filter electrically coupled to the sound detector, the band-pass filter being configured to extract sound signals in a predetermined audible frequency range and to output a corresponding filtered signal, wherein the improvement to the control circuit comprises:

a peak integrator electrically coupled to the band-pass filter, the peak integrator being configured to receive the filtered signal, to average amplitude peaks of the filtered signal and to output a trigger signal based on a predetermined range of the averaged filtered signal; and a controller electrically coupled to the peak integrator, the controller being configured to receive the trigger signal and to provide at least first and second digital control output signals and generate an analog sound output signal in response to the trigger signal, the first and second digital control output signals have a frequency unrelated to the filtered signal.

2. The amusement device according to claim 1, wherein the predetermined frequency range is between about 6.8 KHz and 8.2 KHz.

3. The amusement device according to claim 1, wherein the first digital control output signal controls a light and the second digital control output signal controls a motor.

4. The amusement device according to claim 1, wherein the predetermined range of the averaged filtered signal is selected based upon audible frequency characteristics of sound produced by a toy noise maker.

5. The amusement device according to claim 4, wherein the toy noise maker is shaken to generate the sound.

6. The amusement device according to claim 4, wherein the toy noise maker is a rattle.

7. The amusement device according to claim 1, wherein the controller is one of a sound synthesizer, a microcontroller, a microprocessor, and an application specific integrated circuit.

8. The amusement device according to claim 1, wherein the sound detector is a microphone.

9. An amusement device having a control circuit, the control circuit including a sound detector configured to detect audible sound signals and a band-pass filter electrically coupled to the sound detector, the band-pass filter being configured to extract sound signals in a predetermined audible frequency range and to output a corresponding filtered signal, wherein the improvement to the control circuit comprises:

a peak integrator electrically coupled to the band-pass filter, the peak integrator being configured to receive the filtered signal, to average amplitude peaks of the filtered signal and to output a trigger signal based on a predetermined range of the averaged filtered signal; and a controller electrically coupled to the peak integrator and to the sound detection circuit, the controller being configured to receive the trigger signal and to provide at least first and second digital control output signals in response to the trigger signal, the first digital control output signal disabling the sound detection circuit for a predetermined period of time after receiving the trigger signal and the second digital control output signal controlling one of a light and a motor.

10. A control circuit for an amusement device, wherein the control circuit comprises:

a sound detector configured to detect audible sound signals;

a band-pass filter electrically coupled to the sound detector, the band-pass filter being configured to extract sound signals in a predetermined audible frequency range and to output a corresponding filtered signal;

a peak integrator electrically coupled to the band-pass filter, the peak integrator being configured to receive the filtered signal, to average amplitude peaks of the filtered signal and to output a trigger signal based on a predetermined range of the averaged filtered signal; and a controller electrically coupled to the peak integrator, the controller being configured to receive the trigger signal and to control a light, a motor and a sound output device in response to receiving the trigger signal.

11. A toy set comprising:

a first amusement device that mechanically generates sound in a predetermined audible frequency range when manipulated by a user, the first amusement device being configured to be functionally responsive to manipulation by an infant; and a second amusement device having a control circuit, a light, a motor and a sound output device, the control circuit including:

a sound detector configured to detect audible sound signals generated by the first amusement device;

a band-pass filter electrically coupled to the sound detector, the band-pass filter being configured to extract sound signals in the predetermined audible frequency range and to output a corresponding filtered signal;

a peak integrator electrically coupled to the band-pass filter, the peak integrator being configured to receive the filtered signal, to average amplitude peaks of the filtered signal and to output a trigger signal based on a predetermined range of the averaged filtered signal; and a controller electrically coupled to the peak integrator, the light, the motor and the sound output device, the controller being configured to receive the trigger signal and to provide a first digital control output signal to the light, provide a second digital control output signal to the motor and generate an analog sound output signal to the sound output device in response to the trigger signal, the first and second digital control output signals have a frequency unrelated to the filtered signal.

12. The toy set according to claim 11, wherein the first amusement device is shaken to generate the sound in the predetermined audible frequency range.

13. The toy set according to claim 12, wherein the first amusement device is a rattle with a handle sized to be grasped and shaken by an infant.

14. The toy set according to claim 11, wherein the second amusement device is a toy doll including a rocking mechanism mechanically coupled to the motor, the rocking mechanism causing the toy doll to bend in at least one direction when the motor is activated.

15. The toy set according to claim 11, wherein the controller is one of a sound synthesizer, a microcontroller, a microprocessor, and an application specific integrated circuit.

16. The toy set according to claim 11, wherein the sound detector is a microphone.

17. The toy set according to claim 11, wherein the sound output device is a speaker.

18. The toy set according to claim 11, wherein the controller disables the sound detection circuit for a predetermined period of time after receiving the trigger signal.

19. An amusement device having a control circuit, the control circuit including a sound detector configured to detect audible sound signals and a band-pass filter electrically coupled to the sound detector, the band-pass filter being configured to extract sound signals in a predetermined audible frequency range and to output a corresponding filtered signal, wherein the improvement to the control circuit comprises:

a peak integrator electrically coupled to the band-pass filter, the peak integrator being configured to receive the filtered signal, to average amplitude peaks of the filtered signal and to output a trigger signal based on a predetermined range of the averaged filtered signal; and a controller electrically coupled to the peak integrator, the controller being configured to receive the trigger signal and to control a light, a motor and a sound output device in response to receiving the trigger signal.

* * * * *